United States Patent [19]

Sheets, Jr. et al.

[11] 4,395,857

[45] Aug. 2, 1983

[54] PANELIZED LEG AND SCALE TOWER

[75] Inventors: George Sheets, Jr., Blair, Nebr.; Ted T. Sokol, Jr., 2416 N. 100th St., Omaha, Nebr. 68134

[73] Assignee: Ted T. Sokol, Jr., Omaha, Nebr.

[21] Appl. No.: 4,729

[22] Filed: Jan. 19, 1979

[51] Int. Cl.[3] ..... E04H 7/30

[52] U.S. Cl. ..... 52/245

[58] Field of Search ..... 52/192–197, 52/30, 245–249, 236.2; 187/1 R, 6, 7

[56] References Cited

U.S. PATENT DOCUMENTS

| | | | |
|---|---|---|---|
| 785,521 | 3/1905 | Roach | 52/236.2 |
| 1,316,768 | 9/1919 | Cooper | 52/192 |
| 1,428,710 | 9/1922 | Read | 52/248 |
| 1,600,984 | 9/1926 | Jones | 52/248 |

FOREIGN PATENT DOCUMENTS

| | | | |
|---|---|---|---|
| 2299228 | 1/1975 | France | 52/192 |

*Primary Examiner*—John E. Murtagh

*Attorney, Agent, or Firm*—Zarley, McKee, Thomte, Voorhees & Sease

[57] ABSTRACT

A panelized leg and scale tower is disclosed which is secured to a suitable foundation and which extends upwardly therefrom around the elevator legs. The tower is comprised of a plurality of curved panels which are bolted together to form a cylindrical tower extending for substantially the entire height of the elevator leg. A plurality of horizontal braces are provided within the tower at a predetermined spacing to maintain the cylindrical integrity of the tower when exposed to wind loads. The tower eliminates the need for guy wires or a lattice-type support structure normally used to support the elevator leg.

6 Claims, 2 Drawing Figures

PANELIZED LEG AND SCALE TOWER

BACKGROUND OF THE INVENTION

Bucket elevators are normally employed to elevate grain or the like to a substantial distance above the ground where the grain is then distributed by means of spouting to various storage bins or the like. The height of the bucket elevator can exceed 110 feet. An elevator leg can be self-supporting, theoretically, at any height provided no lateral forces such as wind are allowed to act on the elevator leg.

There are presently available two primary methods of supporting elevator legs against lateral forces. One method of supporting the elevator leg is to secure guy wires to the elevator along the height thereof and extend the same distance outwardly from the leg and secure the wire to the ground by means of anchors or the like. For example, some guy wires to be effective should be anchored as far as 200–300 feet from the elevator leg. The guy wires can be hazardous when machinery is being operated near the base of the elevator leg. If a guy wire or wires were struck by a car or tractor, the elevator leg could collapse and fall causing injury to those persons nearby. Further, the guy wires themselves produce considerable stress on the elevator leg, and unless the guy wire support foundation is carefully designed and placed, movement can occur, causing the elevator leg to move out of plumb. Also, in many instances because of surrounding structures, guy wire systems are many times not feasible.

A second method of supporting elevator legs is by means of a lattice-type support structure. One disadvantage of the lattice-type support structure is that the structure may have considerable lateral movement under wind loads which adversely affects the operation of the elevator leg. For extremely tall elevator legs, the lattice-type framework is not feasible.

Therefore, it is a principal object of the invention to provide a new means for supporting an elevator leg.

A further object of the invention is to provide a means for supporting a bucket elevator which eliminates the need for guy wire supports or lattice-type supports.

A still further object of the invention is to provide a panelized leg and scale tower which shields the elevator leg from lateral forces such as wind or the like.

A still further object of the invention is to provide a means for supporting a bucket elevator which also provides an enclosed work area for facilitating maintenance work on the elevator itself.

A still further object of the invention is to provide a panelized leg and scale tower which is easily asembled.

A still further object of the invention is to provide a means for supporting an elevator leg which is easily erected.

A still further object of the invention is to provide a panelized leg and scale tower which is economical of manufacture and refined in appearance.

These and other objects will be apparent to those skilled in the art.

SUMMARY OF THE INVENTION

Figures 1, 2:
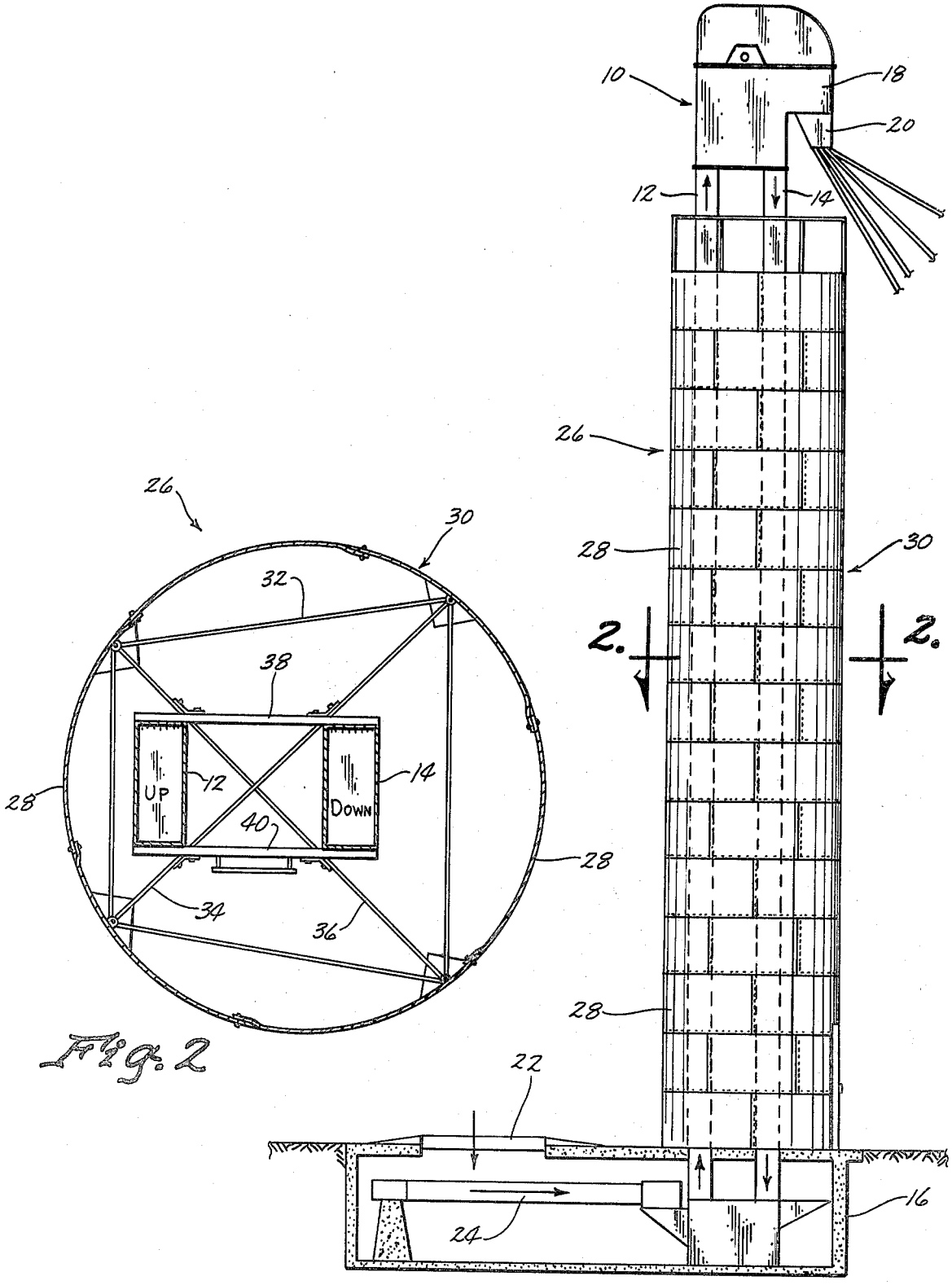
FIG. 1 is a side view of the panelized leg and scale tower of this invention.
FIG. 2 is an enlarged sectional view seen on lines 2—2 of FIG. 1.

A panelized leg and scale tower is disclosed comprised of a plurality of curved metal panels bolted together to create a cylindrical tower which extends around a vertically disposed elevator leg. The tower isolates the leg from lateral forces such as wind or the like. A plurality of horizontal braces are provided within the tower to maintain the cylindrical integrity of the tower when subjected to wind loads.

DESCRIPTION OF THE PREFERRED EMBODIMENT

FIG. 1 illustrates a typical elevator leg 10 of the bucket type. Elevator 10 includes bucket elevator legs 12 and 14 which extend upwardly from a suitable foundation 16 as best illustrated in FIG. 1. Elevator legs 12 and 14 have an elevator head 18 secured to the upper ends thereof which is in communication with a distributor apparatus 20. The numeral 22 refers generally to a receiving area through which the grain or the like is dumped onto the conveyor 24 which supplies the grain to the elevator leg 12. All of the structure just described relating to the bucket elevator is conventional.

The numeral 26 refers generally to the tower of this invention. Tower 26 is comprised of a plurality of curved metal panels 28 which are bolted together so as to form a circular ring referred to generally by the reference numeral 30. The rings 30 are bolted together to form the desired height of the tower. The construction method is primarily that of bolting standard curved metal panels together which can be done without skilled labor. The thickness of the metal panels will depend on the height of the tower and the diameter of the tower. At predetermined intervals, horizontal bracing 32 is provided as best seen in FIG. 2. The purpose of the bracking 32 is to permit the tower to retain its circular shape when subject to wind loads. The elevator legs are tied to the tower only at points where it is deemed advisable to facilitate plumbness and any needed repairs or replacements of elevator leg components. As seen in FIG. 2, cross bracing 34 and 36 extends from the tower between the elevator legs 12 and 14. The cross braces 34 and 36 are bolted to the bracing 38 and 40 of the elevator 10 as also seen in FIG. 2.

The tower disclosed herein is ideally suited for use with scales or the like but it should be understood that the tower may be used in conjunction with any type of elevator legs extending upwardly from a supporting area where it is desired to eliminate guy wire supports or lattice-type supports. The leg and scale tower 26 not only protects the elevator from wind loads but may also support the weight of the distributor and down spouting which may be considerable. By supporting these loads by the tower rather than by the elevator leg, a significant reduction in stress in the elevator leg can be achieved which will make normal repair and maintenance of the elevator leg a much easier task.

The leg and scale tower provides a completely enclosed working area for maintenance and reapir of the elevator leg. If desired, a ladder or the like may be secured to one of the elevator legs and such ladder will be enclosed within the tower, hence providing for a much safer access to the top of the elevator leg to perform normal maintenance. The leg and scale tower provides for a completely waterproof and dustproof working area within the tower if the upper end of the tower is closed. The enclosed tower completely isolates the elevator leg from the elements thereby minimizing repair and maintenance cost.

Although the tower 26 is preferably of the cylindrical type, it should be understood that the tower 26 could also have other cross-sectional configurations such as triangular, hexagonal, octagonal, etc.

As stated, the tower resists the wind load through the structural action of a thin-walled panelized cylindrical tube. The principal function of the tower is to provide an economical means of isolating the elevator leg from lateral forces. Thus, it can be seen that the tower of this invention accomplishes at least all of its stated objectives.

We claim:

1. In combination, a vertically disposed elevator leg assembly having lower and upper ends, and a vertically disposed tower positioned around said leg assembly and extending upwardly from the adjacent lower end of said leg assembly towards the upper end of said leg assembly of isolating the leg assembly from lateral forces, the upper end of said tower terminating at a point below the upper end of said elevator leg assembly to permit the distribution of grain laterally from the upper end of said elevator leg assembly.

2. The combination of claim 1 wherein said tower is substantially cylindrical in shape.

3. The combination of claim 2 wherein said tower is comprised of a plurality of curved metal panels secured together at their adjacent ends and sides to form said cylindrical shape.

4. The combination of claim 3 wherein horizontally disposed bracing is secured to the inside surface of said tower at a predetermined vertical space so that said tower will retain its circular cross-section when subjected to wind loads.

5. The combination of claim 3 wherein said tower is secured to said leg assembly at vertically spaced intervals.

6. The combination of claim 1 wherein said tower has an access door provided therein at the lower end thereof.

* * * * *